US010322581B2

(12) United States Patent
Hirayama

(10) Patent No.: US 10,322,581 B2
(45) Date of Patent: Jun. 18, 2019

(54) ELEMENT SUBSTRATE AND PRINTHEAD

(71) Applicant: CANON KABUSHIKI KAISHA, Tokyo (JP)

(72) Inventor: Nobuyuki Hirayama, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/646,791

(22) Filed: Jul. 11, 2017

(65) Prior Publication Data

US 2018/0037029 A1 Feb. 8, 2018

(30) Foreign Application Priority Data

Aug. 8, 2016 (JP) ..... 2016-155864

(51) Int. Cl.
*B41J 2/14* (2006.01)
*B41J 2/045* (2006.01)

(52) U.S. Cl.
CPC ..... *B41J 2/14072* (2013.01); *B41J 2/0458* (2013.01); *B41J 2/04541* (2013.01); *B41J 2/04563* (2013.01); *B41J 2/14129* (2013.01); *B41J 2/14153* (2013.01)

(58) Field of Classification Search
CPC ..... B41J 2/14072; B41J 2002/14491; B41J 2/14153; B41J 2/14129; B41J 2/04563; B41J 2/04541; B41J 2/0458
See application file for complete search history.

(56) References Cited

U.S. PATENT DOCUMENTS

2016/0214384 A1 7/2016 Kasai et al.

FOREIGN PATENT DOCUMENTS

JP 2007-290361 A 11/2007

*Primary Examiner* — Kristal Feggins
(74) *Attorney, Agent, or Firm* — Venable LLP

(57) ABSTRACT

According to embodiments of the present invention, an element substrate capable of detecting a temperature immediately below a heater with high sensitivity is provided. The element substrate has a multilayer structure, and includes a heater, a first wiring below a position where the heater is provided, and a second wiring below the first wiring. The element substrate further includes a temperature detection element formed by series-connecting a first conductive via for connecting the first wiring and the second wiring, a constant electric current source which supplies a constant electric current, and a voltage detection circuit which detects a voltage obtained by supplying the constant electric current to the temperature detection element.

17 Claims, 12 Drawing Sheets

ELEMENT SUBSTRATE AND PRINTHEAD

BACKGROUND OF THE INVENTION

Field of the Invention

The present invention relates to an element substrate and a printhead, and particularly to, for example, a printhead that incorporates an element substrate with a temperature detection element which detects an ink discharge status.

Description of the Related Art

In a printing apparatus using an inkjet printhead (to be referred to as a printhead hereinafter), a foreign substance may clog an ink orifice (to be referred to as an orifice hereinafter), or a bubble entering into an ink supply channel may clog the supply channel. If this occurs, an ink discharge failure (to be referred to as a discharge failure) from the printhead is caused. In particular, a printing apparatus that prints by using a full-line printhead which supports the full width of a print medium and includes a number of orifices arranged in a line can print at high speed, and thus a process for the discharge failure also needs to be performed at high speed. More specifically, in the printing apparatus that uses the full-line printhead, it is very important that an orifice (discharge nozzle) which causes the discharge failure is specified at high speed, and complimentary printing and an ink discharge recovery operation are performed.

Conventionally, various techniques to solve such a discharge failure have been proposed.

Japanese Patent Laid-Open No. 2007-290361 discloses an element substrate on which a plurality of heaters which generate heat energy for discharging ink from orifices are formed on a silicon (Si) base, and a temperature detection element of a thin film is formed via an interlayer insulation film immediately below each heater. According to Japanese Patent Laid-Open No. 2007-290361, a temperature detection circuit detects temperature information from the respective temperature detection elements and determines, by a difference between a temperature change by a discharge failure and a temperature change when ink is discharged normally, whether ink discharge is normal or suffers from the discharge failure.

The temperature detection elements described in Japanese Patent Laid-Open No. 2007-290361 adopt an arrangement for detecting a small temperature change precisely. FIG. 12 is a layout diagram showing the positional relationship between conventional heaters and temperature detection elements. As shown in FIG. 12, each temperature detection element 3 is folded a plurality of times and arranged immediately below a corresponding one of heaters 5, setting a resistance value high. In this arrangement, in order to increase the resistance value of each temperature detection element 3, it is effective to make, thin and long, the line width of the temperature detection element arranged immediately below the corresponding one of the heaters 5.

However, an area occupied by each heater is restricted, and the size of a corresponding one of the temperature detection elements that can be arranged under that restriction is restricted, as a matter of course. It is therefore difficult to further increase the resistance value of each temperature detection element 3 in order to improve the sensitivity of the temperature detection element 3.

SUMMARY OF THE INVENTION

Accordingly, the present invention is conceived as a response to the above-described disadvantages of the conventional art.

For example, an element substrate according to this invention provides a temperature detection element capable of detecting a heater temperature at higher accuracy, and detecting a nozzle that causes a discharge failure at high speed and high accuracy.

According to one aspect of the present invention, there is provided a multilayer structured element substrate comprising: a heater; and a temperature detection element formed by series-connecting a first wiring below a position where the heater is provided, a second wiring below the first wiring, and a first conductive via configured to connect the first wiring and the second wiring.

According to another aspect of the present invention, there is provided a multilayer structured element substrate comprising: a heater; and a temperature detection element formed by series-connecting a wiring below a position where the heater is provided, and a conductive via configured to connect the heater and the wiring.

According to still another aspect of the present invention, there is provided a printhead which uses the element substrate of the above-described arrangement to discharge ink by giving heat energy to ink by the heater.

The invention is particularly advantageous since a temperature detection element having high sensitivity to a temperature change can be included, making it possible to detect a heater temperature at high speed and high accuracy.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similarly to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

A printhead substrate (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing Apparatus Integrating Full-Line Printhead (FIG. 1)>

Figure 1:
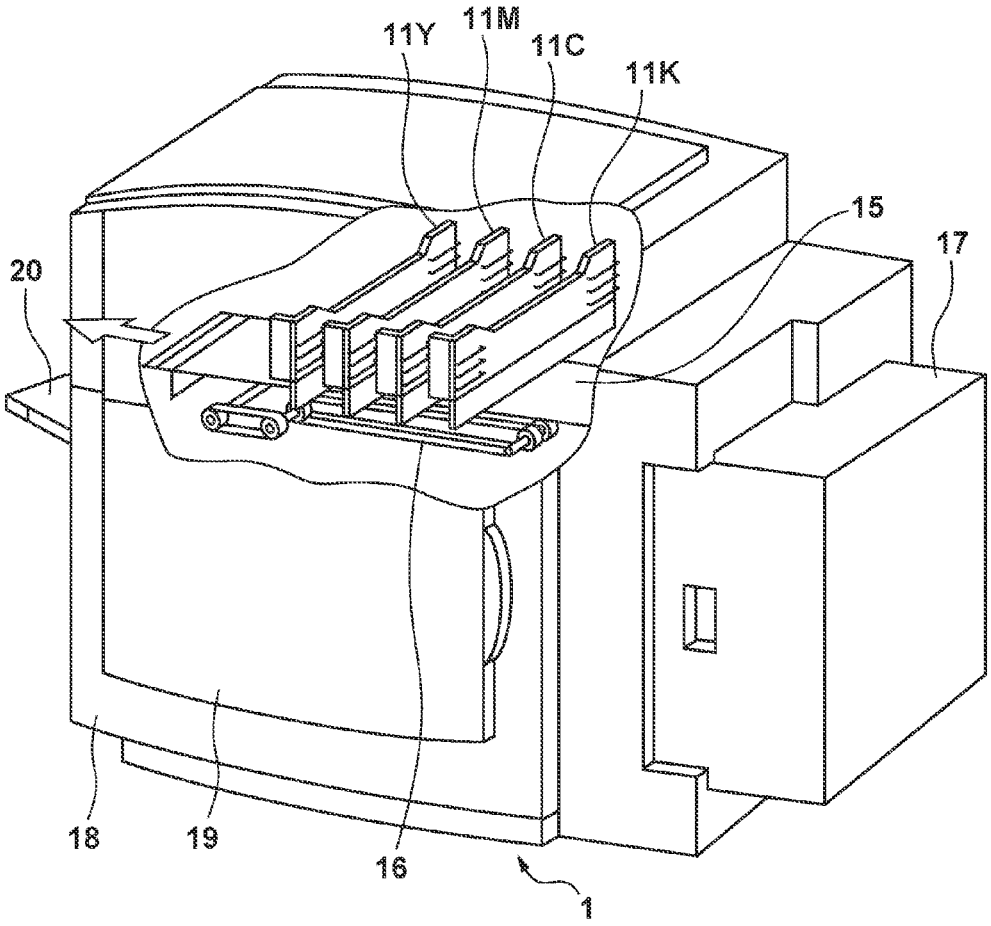
FIG. 1 is a perspective view for explaining the structure of a printing apparatus which includes a full-line printhead according to an exemplary embodiment of the present invention.

FIG. 1 is a perspective view for explaining the structure of a printing apparatus 1 which includes full-line inkjet printheads (to be referred to as printheads hereinafter) 11K, 11C, 11M, and 11Y and a recovery unit configured to guarantee ink discharge that is always stable.

In the printing apparatus 1, a printing paper sheet 15 is supplied from a feeder unit 17 to a print position by these printheads and conveyed by a conveyance unit 16 included in a housing 18 of the printing apparatus.

In printing an image on the printing paper sheet 15, black (K) ink is discharged from the printhead 11K when the reference position of the printing paper sheet 15 reaches under the printhead 11K which discharges the black ink while conveying the printing paper sheet 15. Similarly, when the printing paper sheet 15 reaches respective reference positions in the order of the printhead 11C which discharges cyan (C) ink, the printhead 11M which discharges magenta (M) ink, and the printhead 11Y which discharges yellow (Y) ink, a color image is formed by discharging the inks of the respective colors. The printing paper sheet 15 on which the image is thus printed is discharged to and stacked on a stacker tray 20.

The printing apparatus 1 further includes the conveyance unit 16, and ink cartridges (not shown) configured to supply the inks to the printheads 11K, 11C, 11M, and 11Y and replaceable for each ink. The printing apparatus 1 still further includes, for example, a pump unit (not shown) for a recovery operation and ink supply to the printheads 11K, 11C, 11M, and 11Y, and a control board (not shown) which controls the entire printing apparatus 1. A front door 19 is an opening/closing door for replacing the ink cartridge.

Printheads 11 of this embodiment adopt an inkjet method of discharging the ink by utilizing heat energy. Therefore, the printheads 11 include electrothermal transducers (heaters). Each of these electrothermal transducers is provided in correspondence with a corresponding one of orifices. A pulse voltage is applied to each of the corresponding electrothermal transducers in accordance with a print signal, discharging ink from the corresponding one of the orifices. Note that the printing apparatus is not limited to a printing apparatus which uses a full-line printhead having a printing width corresponding to the width of the print medium described above. The present invention is also applicable to, for example, a so-called serial type printing apparatus which integrates, in a carriage, a printhead with orifices arrayed in the conveyance direction of a print medium and prints by discharging ink to the print medium while reciprocally scanning the carriage.

<Description of Control Arrangement (FIG. 2)>

A control arrangement for performing the print control of the printing apparatus described with reference to FIG. 1 will now be described.

Figure 2:
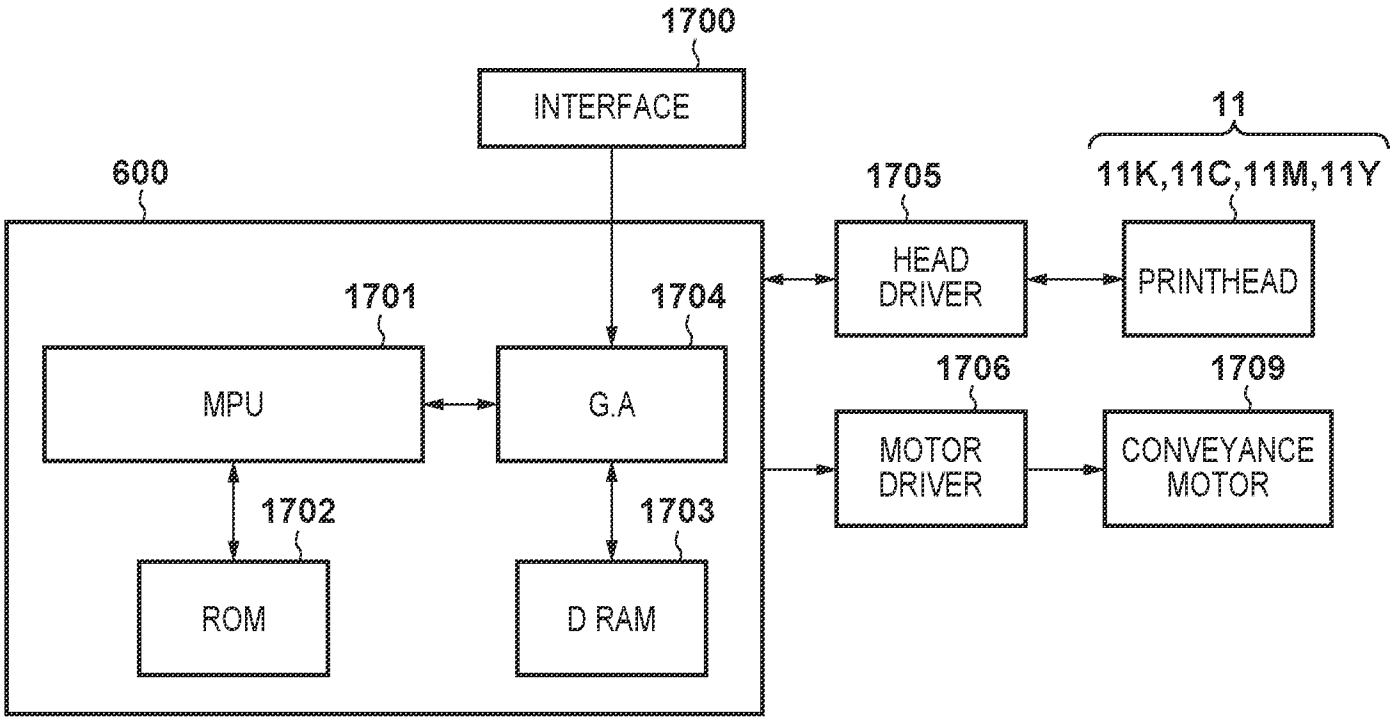
FIG. 2 is a block diagram showing the control arrangement of the printing apparatus shown in FIG. 1.

FIG. 2 is a block diagram showing the arrangement of a control circuit of the printing apparatus. In FIG. 2, an interface 1700 inputs print data, reference numeral 1701 denotes an MPU, a ROM 1702 stores control programs executed by the MPU 1701, and a DRAM 1703 saves print data and data such as a print signal supplied to each printhead. A gate array (G.A.) 1704 performs the supply control of the print signal to each printhead, and also performs data transfer control among the interface 1700, the MPU 1701, and the DRAM 1703. A controller 600 includes the MPU 1701, the ROM 1702, the DRAM 1703, and the gate array 1704. A carriage motor 1710 is configured to convey the printheads 11 (11K, 11C, 11M, and 11Y). A conveyance motor 1709 is configured to convey printing paper. A head driver 1705 drives the printheads. Motor drivers 1706 and 1707 are motor drivers configured to drive the conveyance motor 1709 and the carriage motor 1710, respectively.

In the operation of the above-described control arrangement, when print data enters the interface 1700, the print data is converted into a print signal between the gate array 1704 and the MPU 1701. Then, the motor drivers 1706 and 1707 are driven, and the printheads are driven in accordance with the print data transmitted to the head driver 1705 to print. Information on a transfer error (to be described later) obtained in the printheads is fed back to the MPU 1701 via the head driver 1705 and reflected on the print control.

Some embodiments will now be described regarding an element substrate which is integrated in the printheads mounted on the printing apparatus of the above-described arrangement.

[First Embodiment]

Figure 3A:
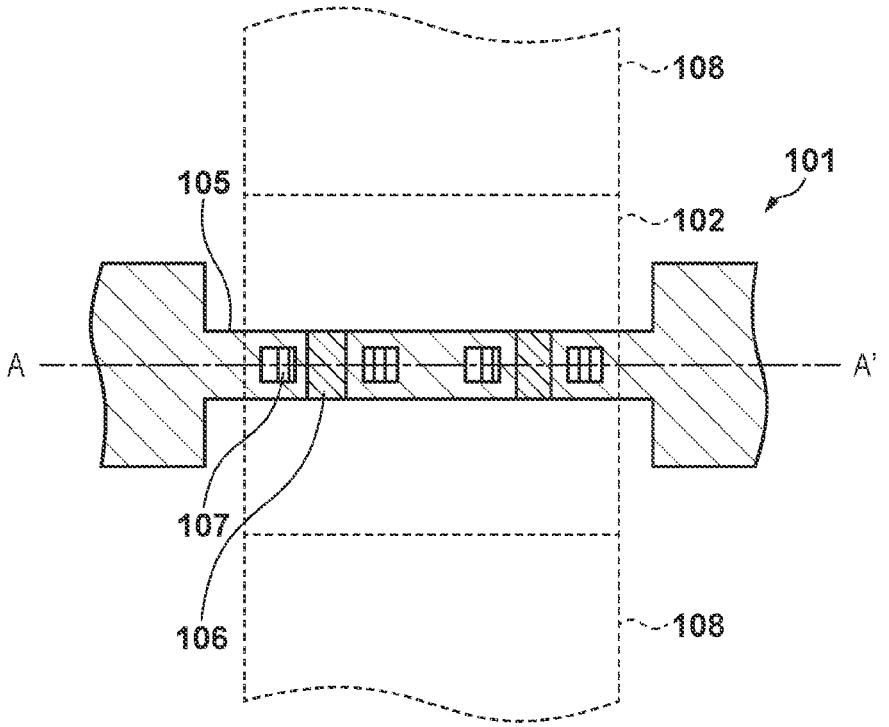
FIGS. 3A and 3B are views showing the positional relationship between a heater and a temperature detection element formed on an element substrate (head substrate) according to the first embodiment of the present invention.
Figure 3B:
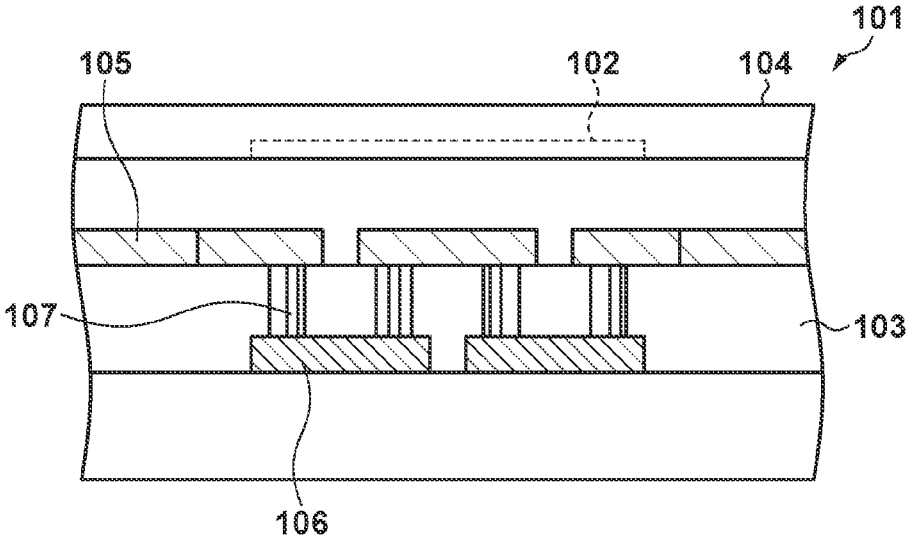

FIGS. 3A and 3B are views showing the positional relationship between a heater and a temperature detection element formed on an element substrate (head substrate) according to the first embodiment of the present invention. FIGS. 3A and 3B show some of a plurality of heaters formed on the element substrate (head substrate). A semiconductor substrate of silicon (Si) or the like is used for an element substrate 101. FIG. 3A is a plan view showing the heater and the temperature detection element arranged immediately below the heater. FIG. 3B is a sectional view taken along a chain line A-A' in FIG. 3A. Note that only one heater is illustrated here. On the element substrate 101, however, the plurality of heaters are integrated in correspondence with a plurality of nozzles which are provided in a printhead and discharge ink.

As shown in FIG. 3A, wirings 108 are connected to the two ends of a heater 102. As shown in FIG. 3B, a protection film 104 is formed on the heater 102. A wiring 105 and wirings 106 are further arranged on an interlayer insulation film 103 below the heater 102. The wiring 105 and the wirings 106 are connected via conductive via 107. As described above, the element substrate 101 has a multilayer structure in which various constituent elements are formed in the different layers, and conductive via which connects the constituent elements formed in the different layers are formed among the layers, as needed.

The temperature detection element is made of these three constituent elements of the wiring 105, the wirings 106, and conductive via 107 that are series-connected. For example, a low-resistance wiring material such as aluminium (Al), AlCu, AlSi, Cu, or the like is used for the wirings 105 and 106. For example, tungsten (W) is used as the conductive via 107.

The wiring 105 and the wirings 106 are connected via a plurality of conductive via 107.

A temperature immediately below the heater is detected as follows.

As shown in FIG. 3A, a voltage is applied to the two ends of the heater 102 from the wirings 108 connected to the heater 102. The heater 102 generates heat upon electric current supply when the voltage is applied. The heat is transferred to ink on the protection film 104 on the heater 102 or ink on a metal film (not shown) in a case where the metal film is formed on the protection film 104, and the ink is discharged by foaming the ink. A change in temperature at this time is detected by monitoring a change in value of a resistance formed by series-connecting the conductive via 107, wirings 106, and wiring 105 provided immediately below the heater 102.

Figure 4:
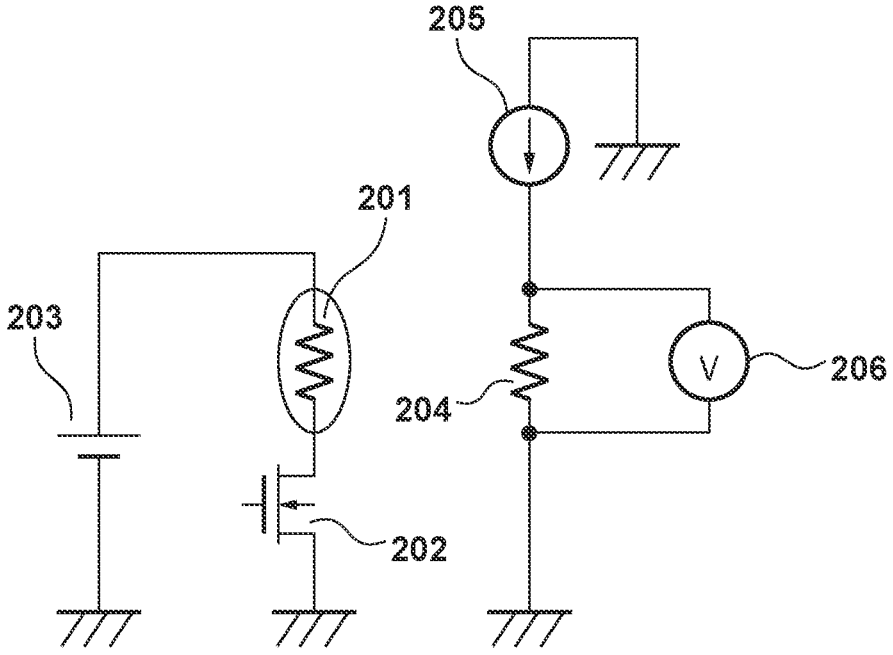
FIG. 4 is a diagram showing equivalent circuits of a temperature detection circuit using the temperature detection element and a driving circuit of the heater described with reference to FIGS. 3A and 3B.

FIG. 4 is a diagram showing equivalent circuits of a temperature detection circuit using the temperature detection element and a driving circuit of the heater described with reference to FIGS. 3A and 3B.

A power supply 203 and a transistor 202 are connected to the two ends of a heater 201 shown in FIG. 4. The transistor 202 is turned on/off in accordance with a control signal applied to its gate, and electric current supply to the heater 201 is controlled. The heater 201 generates heat when a voltage is applied to the heater 201. The heat of the heater 201 is transferred to ink, and a temperature change at this time is detected by a temperature detection element (resistance) 204. Note that the resistance 204 indicates the series resistance of the temperature detection element made of the conductive via 107, and the wirings 105 and 106 shown in FIGS. 3A and 3B.

The heater 201 is heated upon electric current supply when the voltage is applied to the heater 201. A constant electric current source 205 through which a constant electric current flows is connected to one end of the resistance 204 shown in FIG. 4, and the other end of the resistance 204 is connected to ground. Then, a voltage detection circuit 206 which detects a voltage at the two ends of the resistance 204 is connected. In this arrangement, the constant electric current is supplied to the resistance 204 from the constant electric current source 205. Accordingly, the voltage detection circuit 206 connected to the two ends of the resistance 204 measures a voltage generated at the two ends of the resistance 204, reading the resistance value of the resistance 204. This measured voltage value is output outside the element substrate (printhead), allowing, for example, an MPU 1701 of a controller 600 shown in FIG. 2 to calculate the resistance value of the resistance 204.

For example, if tungsten is used as the conductive via, and aluminium is used as the wirings, the respective resistivities of the resistance 204 are about $5.5\times10^{-10}$ Ω·m and about $2.7\times10^{-10}$ Ω·m. The respective temperature coefficients are about 3,800 ppm and about 4,400 ppm. For example, as compared with a case in which a temperature detection element is formed by an aluminium wiring alone in the same area, an electric current can flow in a wiring interlayer direction, making it possible to increase the resistance value by the resistivity of each conductive via. The resistivity and temperature coefficient of tungsten are higher than those of aluminium, making it possible to increase the absolute value and temperature change rate of the resistance value.

Therefore, according to the above-described embodiment, it becomes possible, by forming the temperature detection element across a plurality of layers in the element substrate, to detect the temperature at high accuracy while suppressing an increase in size of the temperature detection element. Furthermore, the conductive via among the layers are desirably formed by a substance such as tungsten or the like having higher resistivity and temperature coefficient than the wiring formed in each layer. This is because it becomes possible to increase detection sensitivity to the temperature change and to detect a heater temperature at higher accuracy.

[Second Embodiment]

Figure 5A:
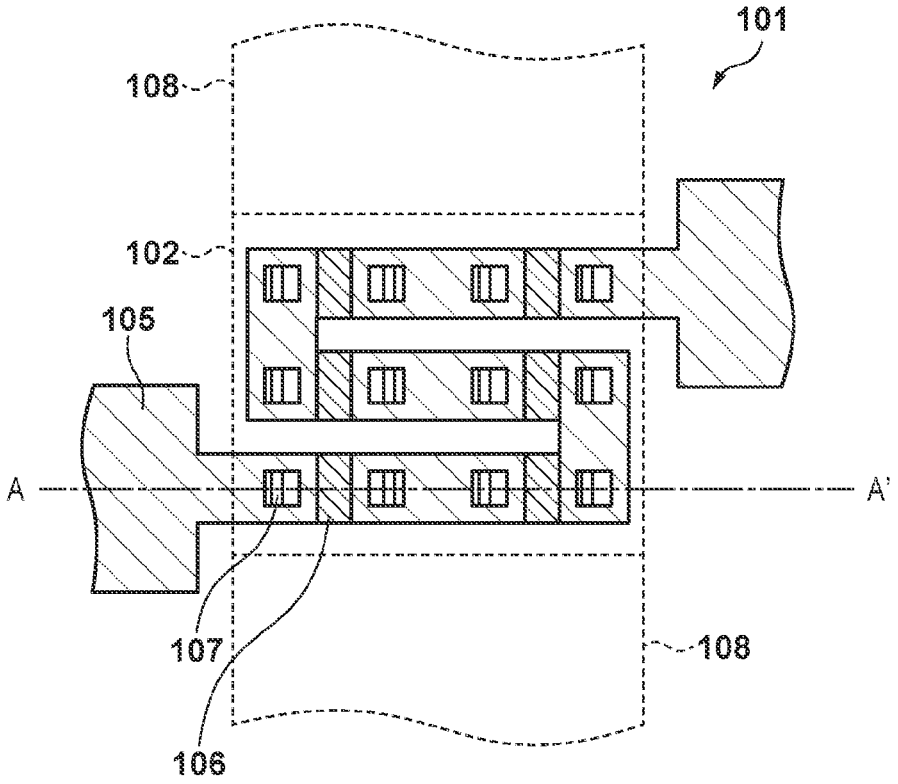
FIGS. 5A and 5B are views showing the positional relationship between a heater and a temperature detection element formed on an element substrate (head substrate) according to the second embodiment of the present invention.
Figure 5B:
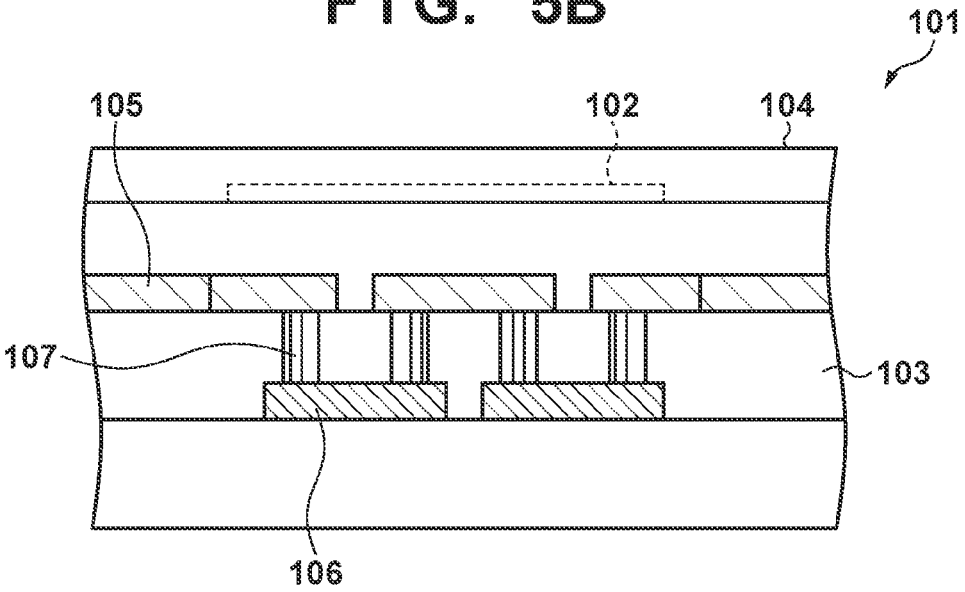

FIGS. 5A and 5B are views showing the positional relationship between a heater and a temperature detection element formed on an element substrate (head substrate) according to the second embodiment of the present invention. Note that as in FIGS. 3A and 3B, FIG. 5A is also a plan view showing the heater and the temperature detection element arranged immediately below the heater, and FIG. 5B is also a sectional view taken along a chain line A-A' in FIG. 5A. In FIGS. 5A and 5B, the same reference numerals denote the same constituent elements that have already been described with reference to FIGS. 3A and 3B, and a description thereof will be omitted.

Only the characteristic arrangement of the second embodiment will be described below.

As seen by comparing FIGS. 5A and 5B with FIGS. 3A and 3B, in this embodiment, the number of conductive via 107 immediately below a heater 102 is increased as compared with the first embodiment. This increase is implemented by forming a series resistance formed by the conductive via 107, wiring 105, and wirings 106 so as to meander under the heater 102 in an area occupied by the heater 102.

Therefore, according to the above-described embodiment, it becomes possible to increase the resistance value of the temperature detection element as compared with the first embodiment and with that increase, it becomes possible to further increase detection sensitivity to a temperature change.

Note that temperature detection according to this embodiment can be performed in the same manner by the same method as that described with reference to FIG. 4 in the first embodiment.

[Third Embodiment]

Figure 6A:
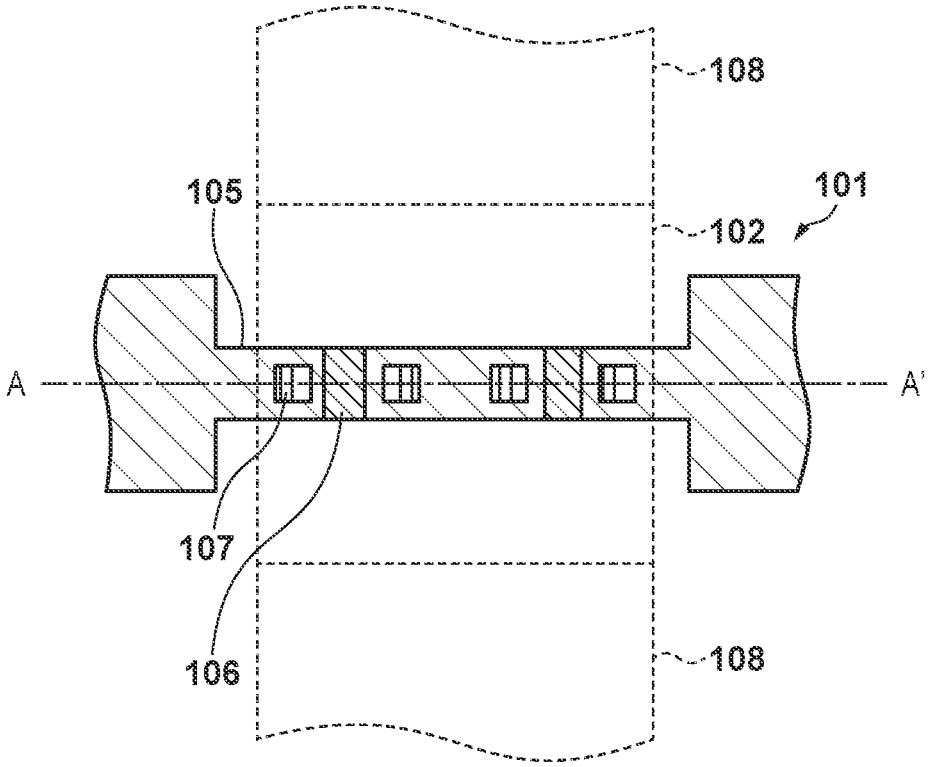
FIGS. 6A and 6B are views showing the positional relationship between a heater and a temperature detection element formed on an element substrate (head substrate) according to the third embodiment of the present invention.
Figure 6B:
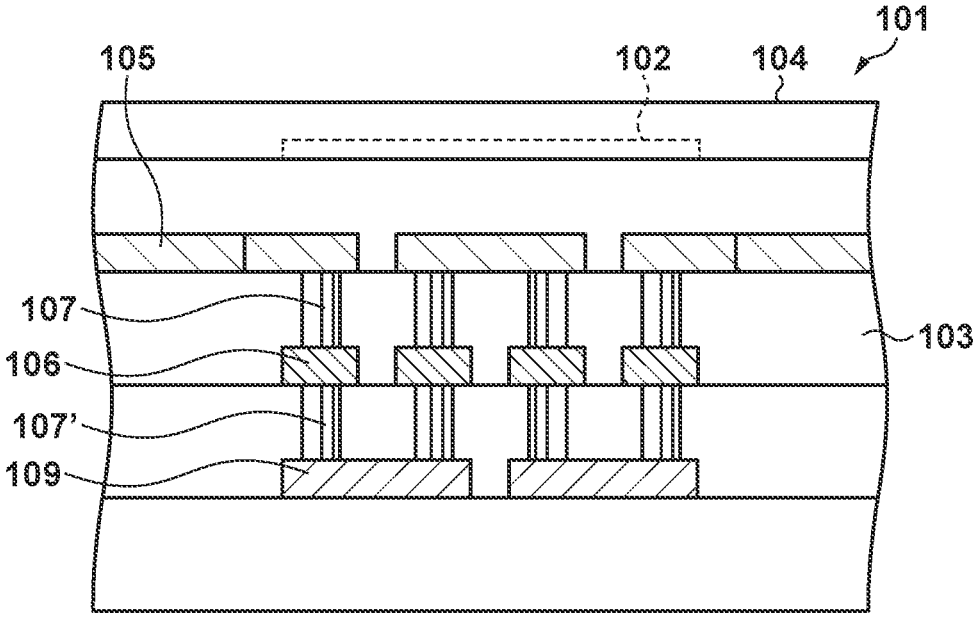

FIGS. 6A and 6B are views showing the positional relationship between a heater and a temperature detection element formed on an element substrate (head substrate) according to the third embodiment of the present invention. Note that as in FIGS. 3A and 3B, FIG. 6A is also a plan view showing the heater and the temperature detection element arranged immediately below the heater, and FIG. 6B is also a sectional view taken along a chain line A-A' in FIG. 6A. In FIGS. 6A and 6B, the same reference numerals denote the same constituent elements that have already been described with reference to FIGS. 3A and 3B, and a description thereof will be omitted.

Only the characteristic arrangement of the third embodiment will be described below.

As seen by comparing FIGS. 6A and 6B with FIGS. 3A and 3B, in this embodiment, one wiring layer is added as compared with the first embodiment. As shown in FIG. 6B, in addition to connecting wiring 105 and wirings 106 by conductive via 107 as in the first embodiment, the wirings 106 and wirings 109 are connected by conductive via 107'. As described above, the wirings 109 and the conductive via 107' are added to the first embodiment.

Therefore, according to the above-described embodiment, it becomes possible, by adding the wirings and conductive via that form the temperature detection element, to increase a series-connected resistance as compared with the first embodiment even though an area occupied in a plane is the same. This makes it possible, by increasing the resistance value of the temperature detection element, to increase detection sensitivity to a temperature change.

Note that temperature detection according to this embodiment can be performed in the same manner by the same method as that described with reference to FIG. 4 in the first embodiment.

[Fourth Embodiment]

Figure 7A:
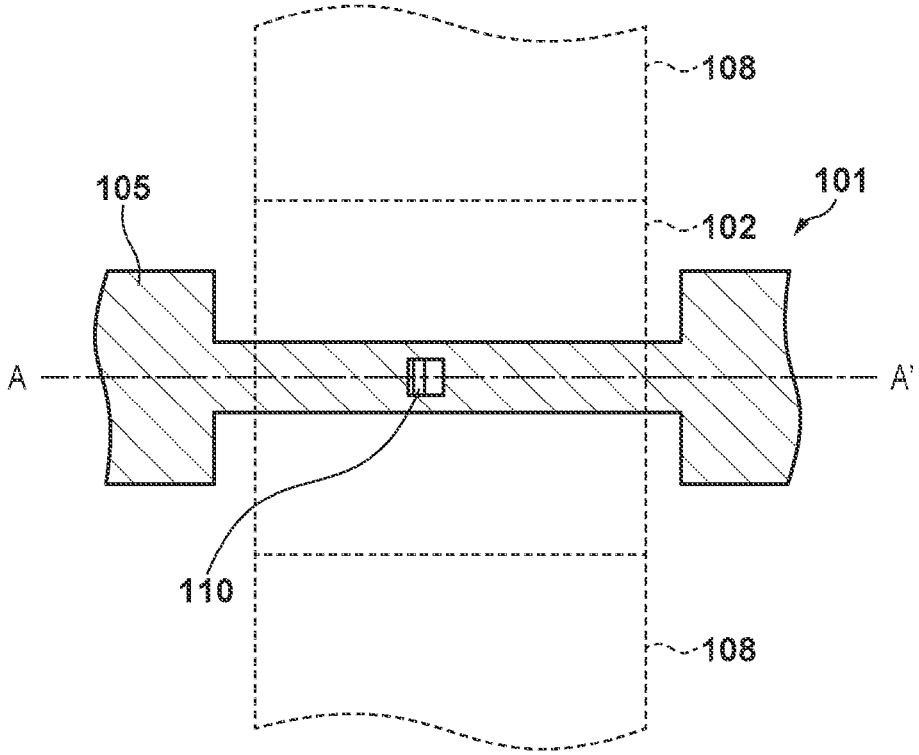
FIGS. 7A and 7B are views showing the positional relationship between a heater and a temperature detection element formed on an element substrate (head substrate) according to the fourth embodiment of the present invention.
Figure 7B:
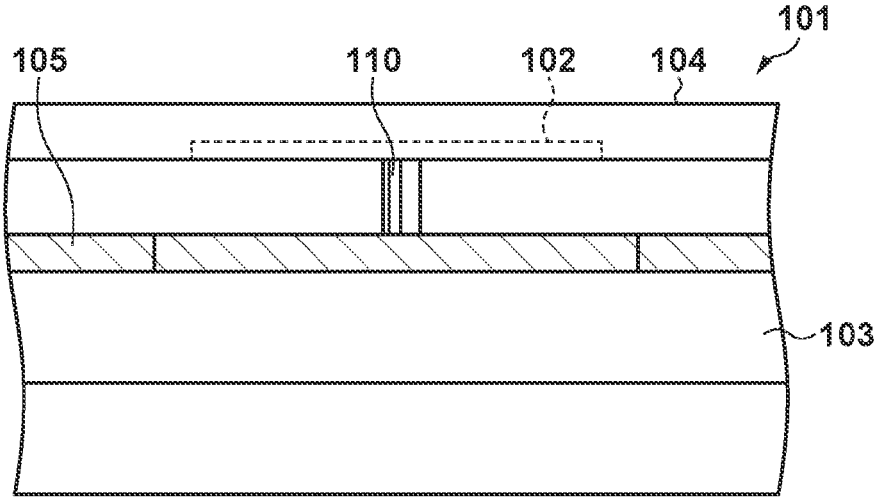

FIGS. 7A and 7B are views showing the positional relationship between a heater and a temperature detection element formed on an element substrate (head substrate) according to the fourth embodiment of the present invention. Note that as in FIGS. 3A and 3B, FIG. 7A is also a plan view showing the heater and the temperature detection element arranged immediately below the heater, and FIG. 7B is also a sectional view taken along a chain line A-A' in FIG. 7A. In FIGS. 7A and 7B, the same reference numerals denote the same constituent elements that have already been described with reference to FIGS. 3A and 3B, and a description thereof will be omitted.

Only the characteristic arrangement of the fourth embodiment will be described below.

As seen by comparing FIG. 7B with FIG. 3B, in particular, a conductive via 110 connects a heater 102 and a wiring 105 in this embodiment.

In this embodiment, the conductive via 110 is used as the temperature detection element, and the heater 102 is used for electric current supply to the temperature detection element and wiring to detect a voltage.

Figure 8A:
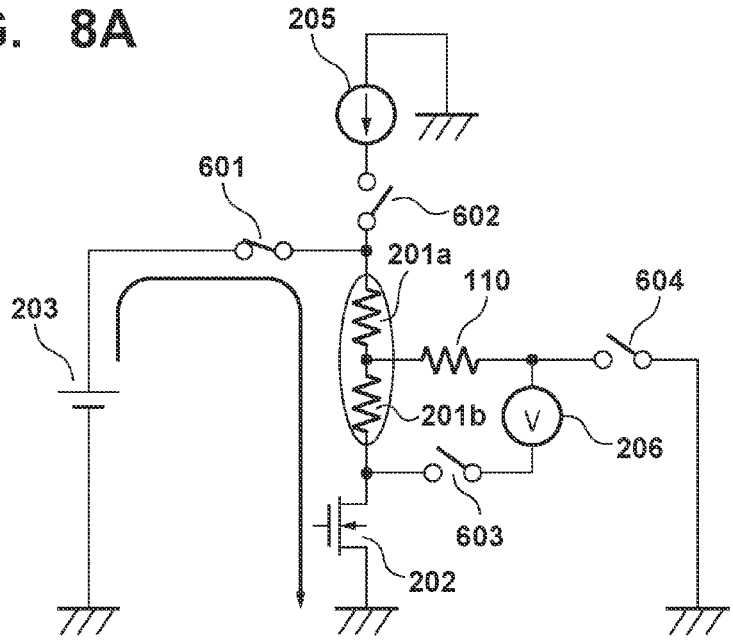
FIGS. 8A and 8B are diagrams each showing equivalent circuits of a temperature detection circuit using the temperature detection element and a driving circuit of the heater described with reference to FIGS. 7A and 7B.
Figure 8B:
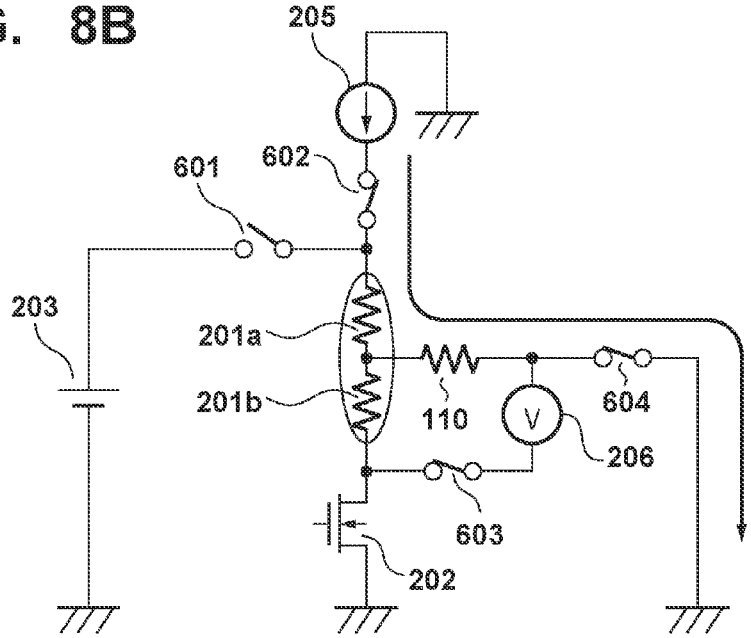

FIGS. 8A and 8B are diagrams each showing equivalent circuits of a temperature detection circuit using the temperature detection element and a driving circuit of the heater described with reference to FIGS. 7A and 7B. In this embodiment, the heater 102 is used as a part of the temperature detection element, making it impossible to perform heater driving and temperature detection simultaneously. As shown by these equivalent circuits, heater driving and temperature detection are performed by switching between them with switches.

FIG. 8A shows a circuit arrangement in an operation mode in which heater driving is performed. FIG. 8B shows a circuit arrangement in an operation mode in which temperature detection is performed. Note that in FIGS. 8A and 8B, the same reference numerals denote the same constituent elements that have already been described with reference to FIG. 4, and a description thereof will be omitted.

As shown in FIGS. 8A and 8B, heaters 201*a* and 201*b* form one heater, and the node of the conductive via 110 in FIGS. 7A and 7B indicates the node between the heater 201*a* and the heater 201*b*. A power supply 203 is connected to one end of the heater 201*a* via a switch 601. One end of the heater 201*b* is connected to ground via a transistor 202 which controls driving of the heater. One end of the conductive via 110 is connected to the node between the heaters 201*a* and 201*b* (as for the entire heater, a midpoint thereof). The other end of the conductive via 110 is connected to ground via one end of a voltage detection circuit 206 and a switch 604. The other end of the voltage detection circuit 206 is connected to the node between the heater 201*b* and the transistor 202 via a switch 603. A constant electric current source 205 is connected to the node between the heater 201*a* and the switch 601 via a switch 602.

An operation at the time of heater driving will be described here with reference to FIG. 8A.

At the time of the operation mode in which heater driving is performed, the switch 601 is closed, and the switches 602, 603, and 604 are opened. On the other hand, the transistor 202 is ON/OFF-controlled, by a control signal, to supply an electric current to the heaters 201*a* and 201*b*. Since the switches 602, 603, and 604 are opened, the voltage detection circuit 206 and the constant electric current source 205 for temperature detection are not connected to the temperature detection element (heaters 201*a* and 201*b*).

A temperature detection operation will now be described with reference to FIG. 8B.

At the time of the operation mode in which temperature detection is performed, the switch 601 is opened, and the switches 602, 603, and 604 are closed. On the other hand, the transistor 202 is turned off by a control signal. At this time, an electric current flows from the constant electric current source 205 to ground via the heater 201, the conductive via 110, and the switch 604 as indicated by a solid arrow. The voltage detection circuit 206 is connected to the heater 201*b* via the conductive via 110 and the switch 603 to measure a potential difference between the two ends of the voltage detection circuit 206. Since the electric current flows as indicated by the solid arrow, the electric current from the constant electric current source 205 does not flow through the switch 603 and the heater 201*b* connected to the voltage detection circuit 206. Since no potential difference occurs between the two ends of the heater 201*b* and switch 603 that are series-connected, only the potential difference of the conductive via 110 is measured at the two ends of the voltage detection circuit 206.

As compared with the first to third embodiments, for this embodiment, the conductive via 110 of the temperature detection element is connected to the heater, making it possible to detect a temperature change immediately above the heater with high sensitivity.

Only the resistance value of the conductive via 110 is detected, making it possible to detect a temperature change in a planar small region for one conductive via indicated in the conductive via 110 of FIG. 7A and to increase detection sensitivity to a temperature change in central portion of the heater.

Figure 9A:
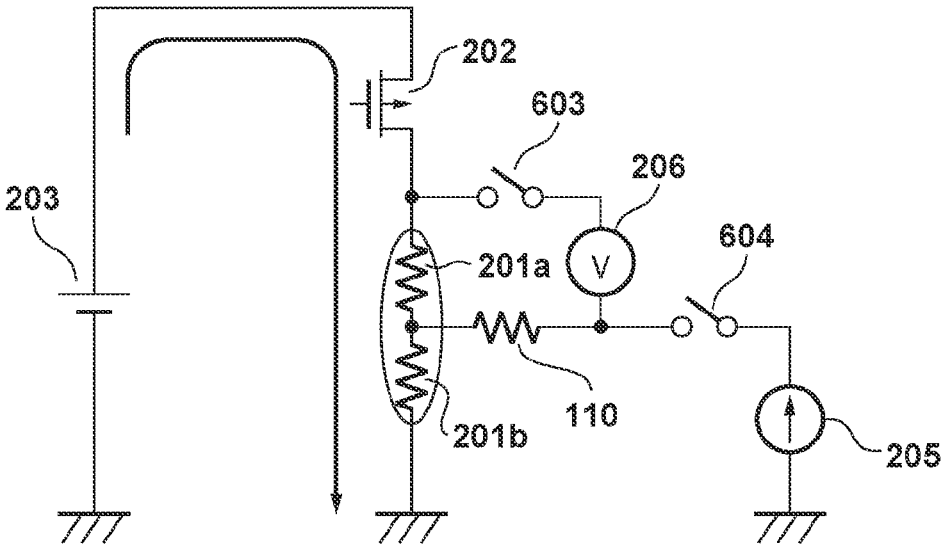
FIGS. 9A and 9B are diagrams each showing another arrangement of equivalent circuits of a temperature detection circuit using the temperature detection element and a driving circuit of the heater described with reference to FIGS. 7A and 7B.
Figure 9B:
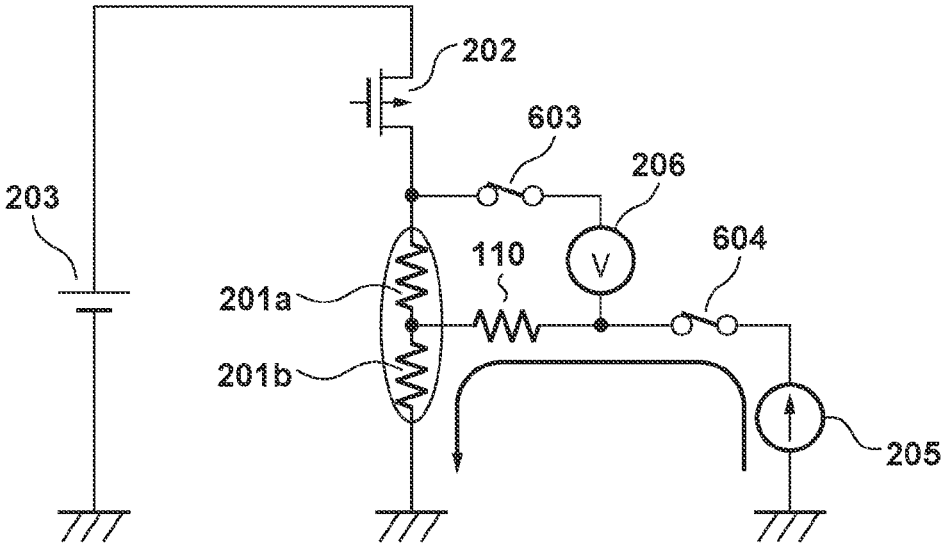

FIGS. 9A and 9B are diagrams each showing equivalent circuits with another arrangement of a temperature detection circuit using the temperature detection element and a driving circuit of the heater described with reference to FIGS. 7A and 7B. Note that in FIGS. 9A and 9B, the same reference numerals denote the same constituent elements that have already been described with reference to FIG. 4, and FIGS. 8A and 8B, and a description thereof will be omitted.

As compared with the arrangement of the equivalent circuits shown in each of FIGS. 8A and 8B, in the circuit arrangement shown in each of FIGS. 9A and 9B, the transistor 202 which supplies an electric current to the heater is connected to a high voltage side. As in FIGS. 8A and 8B, FIG. 9A shows the circuit arrangement in an operation mode in which heater driving is performed, and FIG. 9B shows the circuit arrangement in an operation mode in which temperature detection is performed. In each of these arrangements, one end of a conductive via 110 is connected to the midpoint of the heater 102, as also indicated from FIGS. 7A and 7B.

In each of these arrangements, the switch 601 for shutting down power from the power supply 203 to the heater needed in the circuit arrangement shown in each of FIGS. 8A and 8B becomes unnecessary when temperature detection is performed. However, the operation is performed in the same manner as in FIGS. 8A and 8B.

When heater driving is performed, a voltage drop by the resistance of the switch 601 series-connected to the heater occurs in FIGS. 8A and 8B. However, a voltage drop by the resistance of the switch 601 does not occur in the circuit arrangement shown in each of FIGS. 9A and 9B, making it possible to supply energy to the heater efficiently. In addition, as the switch 601 can be omitted, a layout area can be reduced accordingly. As a result, it is possible to lower the cost of the element substrate.

Note that it is possible to control ON/OFF of the switches shown in FIGS. 8A to 9B by, for example, switching signals (not shown) from an MPU 1701 of a controller 600 shown in FIG. 2. In order to reduce the number of switching signals, it is also possible to adopt a circuit arrangement in which switching is performed in synchronization with ON/OFF of a control signal applied to the gate of the transistor 202. In either case, an arrangement suffices in which the electric current from the constant electric current source 205 flows through the conductive via 110 and the heater in a mode in which temperature detection is performed, and the electric current from the power supply 203 flows through the heater in a mode in which heater driving is performed.

[Fifth Embodiment]

Figure 10A:
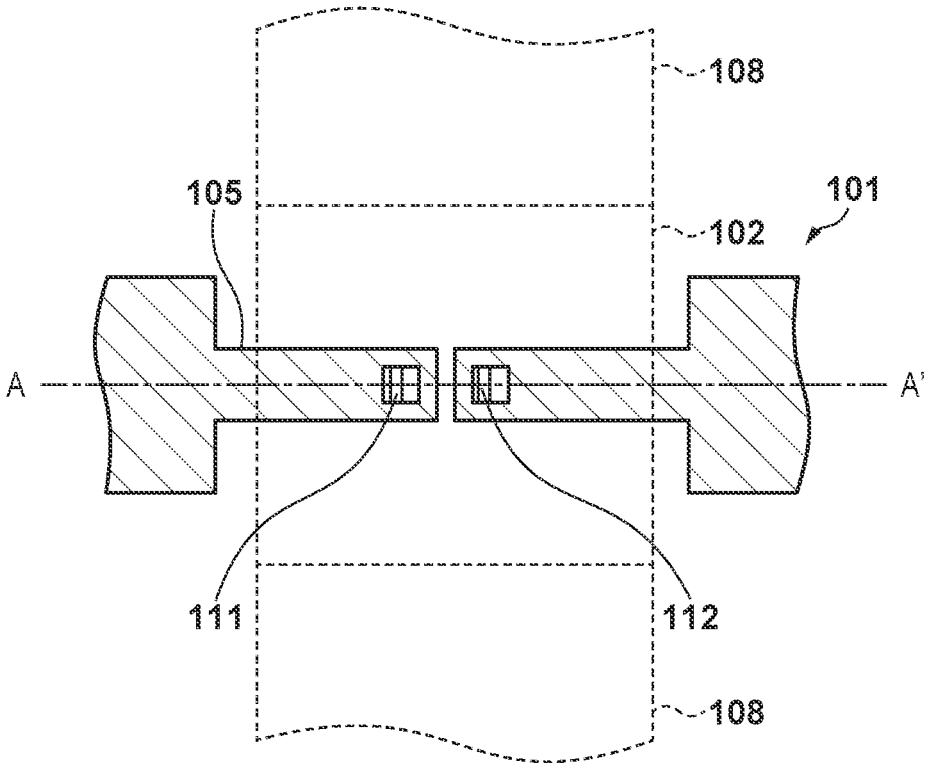
FIGS. 10A and 10B are views showing the positional relationship between a heater and a temperature detection element formed on an element substrate (head substrate) according to the fifth embodiment of the present invention.
Figure 10B:
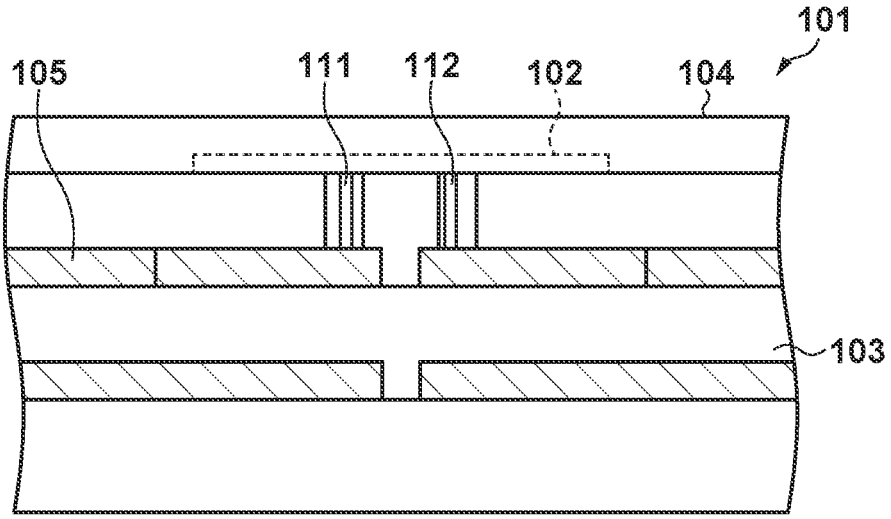

FIGS. 10A and 10B are views showing the positional relationship between a heater and a temperature detection element formed on an element substrate (head substrate) according to the fifth embodiment of the present invention. Note that as in FIGS. 3A and 3B, FIG. 10A is also a plan view showing the heater and the temperature detection element arranged immediately below the heater, and FIG. 10B is also a sectional view taken along a chain line A-A' in FIG. 10A. In FIGS. 10A and 10B, the same reference numerals denote the same constituent elements that have already been described with reference to FIGS. 3A and 3B, and a description thereof will be omitted.

Only the characteristic arrangement of the fifth embodiment will be described below.

In this embodiment, the heater is used as a part of the temperature detection element, as in the fourth embodiment. As shown in FIG. 10B, conductive via 111 and 112 are connected between a heater 102 and wirings 105. In this embodiment, as compared with the first embodiment, the heater is used as a part of a wiring layer used for the temperature detection element, as in the fourth embodiment.

Therefore, the temperature detection element according to this embodiment is made of, for example, a resistance formed by the wirings 105, conductive via 111, the heater 102, and conductive via 112 that are series-connected. Then, also in this embodiment, temperature detection is performed by a temperature change in resistance value of a series-connected combined resistance, as in the first embodiment.

Figure 11A:
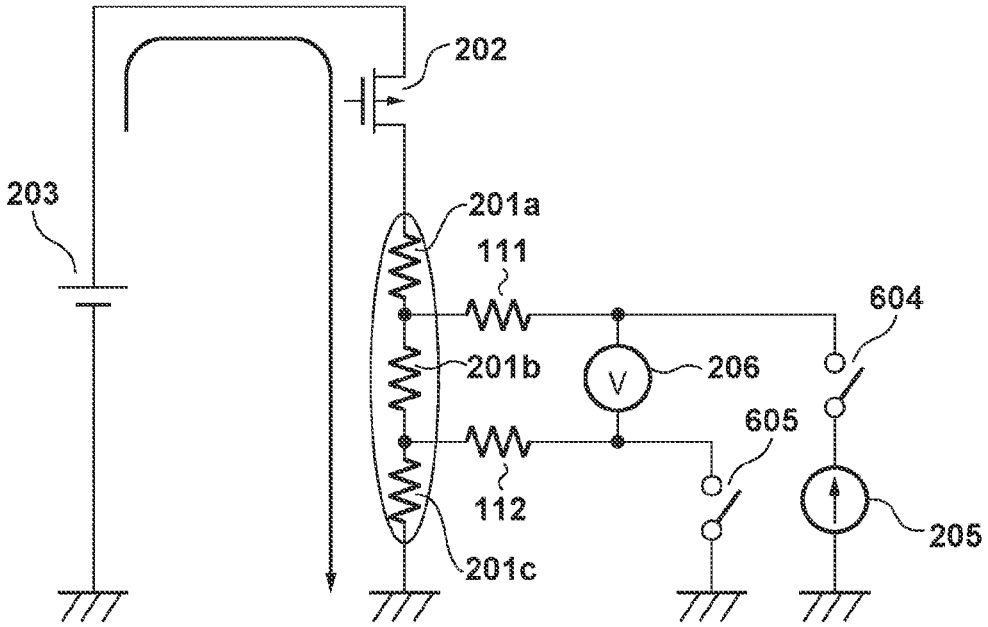
FIGS. 11A and 11B are diagrams each showing equivalent circuits of a temperature detection circuit using the temperature detection element and a driving circuit of the heater described with reference to FIGS. 10A and 10B.
Figure 11B:
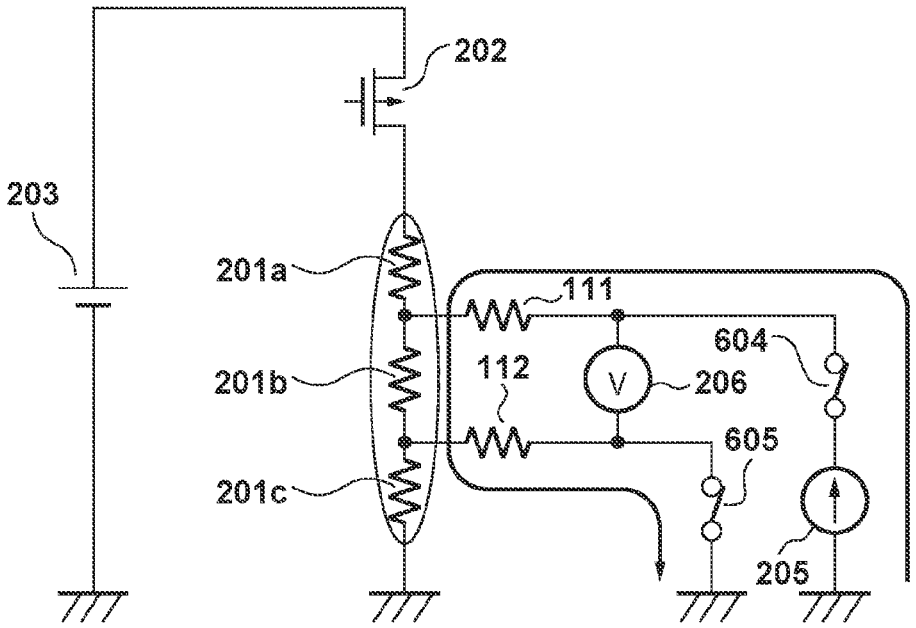
Figure 12:
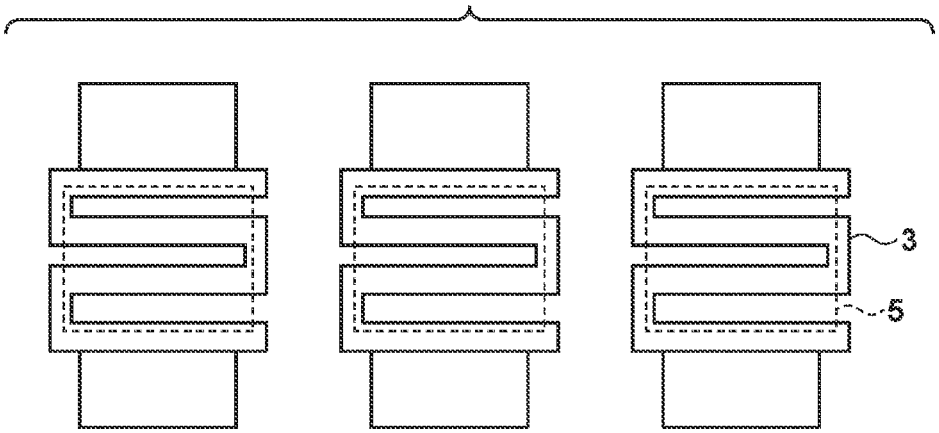
FIG. 12 is a layout diagram showing a conventional element substrate.

FIGS. 11A and 11B are diagrams each showing equivalent circuits of a temperature detection circuit using the temperature detection element and a driving circuit of the heater described with reference to FIGS. 10A and 10B. In this embodiment, the heater 102 is used as the part of the temperature detection element, making it impossible to perform heater driving and temperature detection simultaneously. As shown by these equivalent circuits, heater driving and temperature detection are performed by switching between them with switches.

FIG. 11A shows a circuit arrangement in an operation mode in which heater driving is performed. FIG. 11B shows a circuit arrangement in an operation mode in which temperature detection is performed. Note that in FIGS. 11A and 11B, the same reference numerals denote the same constituent elements that have already been described with reference to FIG. 4, and FIGS. 8A and 8B, and a description thereof will be omitted.

An operation at the time of heater driving will be described here with reference to FIG. 11A.

At the time of heater driving, switches 604 and 605 are opened. The transistor 202 is ON/OFF-controlled, by a control signal, to supply an electric current to the heater. At this time, since the switches 604 and 605 are opened, a constant electric current source 205 for temperature detection is not connected to the temperature detection element.

The operation of temperature detection will now be described with reference to FIG. 11B.

At the time of temperature detection, the switches 604 and 605 are closed. The transistor 202 is turned off by a control signal. On the other hand, an electric current flows from the constant electric current source 205 to ground via the switch 604, the conductive via 111, a heater 201*b*, the conductive via 112, and the switch 605 as indicated by a solid arrow. A voltage detection circuit 206 measures a potential difference between the two ends of the conductive via 111, the heater 201*b*, and the conductive via 112 that are series-connected. In this manner, temperature detection is performed by detecting a temperature change in resistance value of the temperature detection element formed by the conductive via 111, the heater 201*b*, and the conductive via 112 that are series-connected.

For this embodiment, the arrangement is capable of detecting the temperature change above the heater more easily than the arrangement according to the first embodiment. This makes it possible to increase detection sensitivity to the temperature change of the temperature detection element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-155864, filed Aug. 8, 2016, which is hereby incorporated by reference herein in its entirety.

What is claimed is:

1. A multilayer structured element substrate comprising:

a heater; and a temperature detection element formed by series-connecting a first wiring below a position where the heater is provided, a second wiring below the first wiring, and a first conductive via configured to connect the first wiring and the second wiring, wherein the first wiring includes a first portion and a second portion, the second wiring includes a third portion and a fourth portion, and the first portion, the third portion, the second portion, and the fourth portion are series-connected in order by the first conductive via.

2. The element substrate according to claim 1, wherein the temperature detection element is formed to meander in an area occupied by the heater.

3. The element substrate according to claim 1, wherein a third wiring below the second wiring and a second conductive via configured to connect the second wiring and the third wiring are further series-connected with the temperature detection element.

4. The element substrate according to claim 3, wherein the first wiring and the second wiring are connected by using a plurality of the first conductive via, and the second wiring and the third wiring are connected by using a plurality of the second conductive via.

5. The element substrate according to claim 3, wherein aluminum is used for the first wiring, the second wiring, and the third wiring, and tungsten is used for the first conductive via and the second conductive via.

6. The element substrate according to claim 1, wherein the first wiring and the second wiring are connected by using a plurality of the first conductive via.

7. The element substrate according to claim 1, wherein aluminum is used for the first wiring and the second wiring, and tungsten is used for the first conductive via.

8. The element substrate according to claim 1, further comprising:

a constant electric current source configured to supply a constant electric current; and a voltage detection circuit configured to detect a voltage obtained by supplying the constant electric current to the temperature detection element by the constant electric current source.

9. A multilayer structured element substrate comprising:

a heater;

a first wiring connected to both ends of the heater;

a temperature detection element formed by series-connecting a second wiring below a position where the heater is provided, and a conductive via configured to connect the heater and the second wiring; and a switch configured to switch between a first mode in which a temperature is detected by connecting a constant electric current source configured to supply a constant electric current to the temperature detection element and a second mode in which the heater is driven by connecting a power supply to the heater, wherein a voltage detection circuit detects a voltage obtained by supplying the constant electric current to the temperature detection element by the constant electric current source, and wherein the first mode and the second mode are not simultaneously performed.

10. The element substrate according to claim 9, further comprising a transistor configured to drive the heater by supplying an electric current to the heater, wherein the transistor is connected between the heater and ground, one end of the conductive via is connected to the heater, the switch includes:

a first switch provided between the power supply and the heater;

a second switch provided between the constant electric current source and the heater;

a third switch provided between the voltage detection circuit, and a node between the heater and the transistor; and a fourth switch provided between the conductive via and ground, in the first mode, the first switch is opened, and the second switch, the third switch, and the fourth switch are closed, and in the second mode, the first switch is closed, and the second switch, the third switch, and the fourth switch are opened.

11. The element substrate according to claim 10, wherein the one end of the conductive via is connected to a midpoint of the heater.

12. The element substrate according to claim 9, further comprising a transistor configured to drive the heater by supplying an electric current to the heater, wherein the transistor is connected between the heater and the power supply, one end of the conductive via is connected to the heater, the switch includes:

a first switch provided between the voltage detection circuit, and a node between the heater and the transistor; and a second switch provided between the constant electric current source and another end of the conductive via, in the first mode, the first switch and the second switch are closed, and in the second mode, the first switch and the second switch are opened.

13. The element substrate according to claim 12, wherein the one end of the conductive via is connected to a midpoint of the heater.

14. The element substrate according to claim 9, further comprising a transistor configured to drive the heater by supplying an electric current to the heater, wherein the transistor is connected between the heater and the power supply, the conductive via includes a first conductive via and a second conductive via, one end of the first conductive via is connected the heater, one end of the second conductive via is connected to the heater, the switch includes:

a first switch provided between another end of the first conductive via and the constant electric current source; and a second switch provided between ground and another end of the second conductive via, in the first mode, the first switch and the second switch are closed, and in the second mode, the first switch and the second switch are opened.

15. The element substrate according to claim 14, wherein the one end of the first conductive via is connected to a first midpoint of the heater, and the one end of the second conductive via is connected to a second midpoint of the heater.

16. A printhead comprising:

multilayer structured element substrate comprising:

a heater; and a temperature detection element formed by series-connecting a first wiring below a position where the heater is provided, a second wiring below the first wiring, and a conductive via configured to connect the first wiring and the second wiring, wherein the first wiring includes a first portion and a second portion, the second wiring includes a third portion and a fourth portion, and the first portion, the third portion, the second portion, and the fourth portion are series-connected in order by the first conductive via, and wherein ink is discharged by giving heat energy to ink by the heater.

17. The printhead according to claim 16, wherein the printhead is a full-line printhead having a printing width corresponding to a width of a print medium.

* * * * *